United States Patent [19]

Van Litsenburg

[11] 4,030,900

[45] June 21, 1977

[54] COOLING DEVICE

[75] Inventor: Joannes Wilhelmus Van Litsenburg, Eindhoven, Netherlands

[73] Assignee: U.S. Philips Corporation, New York, N.Y.

[22] Filed: Dec. 19, 1975

[21] Appl. No.: 642,347

[30] Foreign Application Priority Data

Feb. 24, 1975 Netherlands ..... 7502147

[52] U.S. Cl. ..... 62/514 R
[51] Int. Cl.[2] ..... F25B 19/00
[58] Field of Search ..... 62/118, 500, 514 R, 62/52, 54

[56] References Cited

UNITED STATES PATENTS

| | | | |
|---|---|---|---|
| 3,908,397 | 9/1975 | Prast et al. | 62/514 R |
| 3,910,063 | 10/1975 | Prast | 62/514 R |

*Primary Examiner*—Ronald C. Capossela
*Attorney, Agent, or Firm*—Frank R. Trifari; Rolf E. Schneider

[57] ABSTRACT

A cooling device comprising a cooling element which is arranged in a space to be cooled. The cooling element has connected thereto an inlet duct for a cooled medium flow, which successively includes, viewed in the downstream direction, a heat exchanger in heat-exchanging contact with the cooling element but heat-insulated with respect to the space, and a restriction for blocking the medium flow in the case of an inadmissible temperature rise of the space.

6 Claims, 3 Drawing Figures

COOLING DEVICE

The invention relates to a cooling device for lowering the temperature of a sealed space or chamber. The chamber of such a device will conventionally contain at least one or more cooling elements the inlet or inlets of which communicate with an inlet duct for a flow of cooled medium, and the outlet or outlets thereof communicate with a medium outlet duct. The ducts pass through at least one boundary wall of the space. The inlet duct includes at least one restriction and at least one heat exchanger on the side of the restriction remote from the cooling element.

A cooling device of this kind is generally described in the published Netherlands Patent Application 7304884 corresponding to U.S. Pat. No. 3,908,397.

In such devices, the cooled space may be, for example, the space inside a cryostat which contains a liquefied gas, the space inside a freeze-drying installation or a deep-freezer containing, a (high) vacuum space etc.

In the known cooling device, the heat exchanger is included on the one side in the medium inlet duct and on the other side in the medium outlet duct and constitutes, in conjunction with the restriction, a blocking device without moving parts. The blocking device at least substantially blocks the flow of cooled medium to the cooling element in the case of increased heat leakage from the surroundings to the space, which becomes apparent as a relatively large temperature rise in the space. The increased heat leakage can occur, for example, in the case of a cryostat having a leaking vacuum jacket.

For the operation of this blocking device use is made of the pronounced decrease in the density of circulating liquid cooling medium (transition liquid/gas) occurring in the space due to the temperature rise, or of the combination of the decrease of the density and the increase of the viscosity of circulating gaseous cooling medium.

In such a cooling device, other spaces forming part of the equipment and their associated cooling elements which are included in the same system of ducts as the cooling element in the leaking space are protected against the supply of heat which flow into the latter space due to the leakage.

It is therefore the object of the present invention to provide a cooling device of the kind set forth which offers an improved, more compact construction.

So as to realize this object, the cooling device according to the invention is characterized in that the heat exchanger is arranged in the space in heat-exchanging contact with the cooling element, while being heat-insulated from the space.

When use is made of liquid cooling medium, some cooling medium in the gaseous phase always is present therein because of the non-ideal heat insulation of the medium inlet duct. During normal operation, this gas at least substantially condenses in the heat exchanger due to cooling by means of the cooling medium having lower pressure and temperature in the cooling element, and which has passed the restriction. In the case of increased heat supply to the space, and the resulting temperature rise occurring therein, additional gas is formed by evaporation of liquid cooling medium in the heat exchanger via the thermal contact with the cooling element.

In order to stimulate the gaseous cooling medium component to flow in the direction of the restriction rather than rise in the opposite direction in liquid cooling medium because of the lower specific weight, a preferred embodiment of the cooling device according to the invention is characterized in that the inlet of the heat exchanger is situated at a level in the space which is lower than that of the outlet.

In the event of leakage, a more rapid and effective blocking of the cooling medium flow is thus achieved, and the gas is not liable to collect in the heat exchanger or medium inlet duct.

In a further preferred embodiment of the cooling device according to the invention, the inlet duct includes, between the heat exchanger and the restriction, at least one heat-exchanging element which is arranged in the space in readily heat-exchanging contact with this space.

An even quicker operation of the blocking mechanism is thus obtained.

The invention will now be described in detail hereinafter with reference to the diagrammatic drawing, which is not to scale, and wherein.

Figure 1:
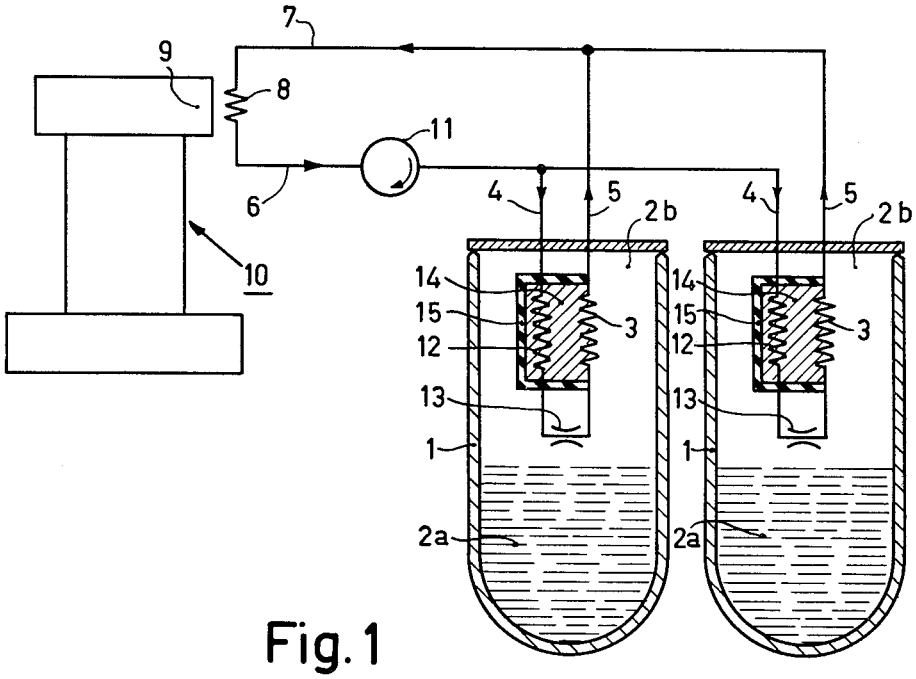
FIG. 1 is a longitudinal sectional view of a cooling device in which a cooling medium circulates in a closed system of ducts, the said cooling medium on the one side taking up cold from the cold head of a cold-gas refrigerator and on the other side giving cold off to the vapour spaces of two storage vessels (Dewars) for liquefied gas.

The reference 1 in FIG. 1 denotes two Dewar vessels wherein a liquefied gas, in this case liquid hydrogen, is present under atmospheric pressure in liquid spaces 2*a*. In the vapour spaces 2*b* of these vessels a cooling coil 3 is arranged, the inlet of which is connected to an inlet duct 4 for cooled medium, its outlet being connected to an outlet duct 5. The inlet ducts 4 communicate with a main inlet duct 6 and the outlet ducts 5 communicate with a main outlet duct 7. A heat exchanger 8 for exchanging heat with the cold head 9 of a cold-gas refrigerator 10 communicates on the one side with the main inlet duct 6 and on the other side with the main outlet duct 7.

A pumping device 11, included in the main inlet duct 6, serves to circulate a cooling medium, in this case liquid hydrogen, which is applied to the inlet duct 4 by the pumping device 11 inder a pressure which is greater than the atmospheric pressure.

The portions of the inlet ducts 4 which are situated in the vapour spaces 2*b* include a heat exchanger 12 and a restriction 13.

Each of the heat exchangers 12 is in good heat-exchanging contact with the neighbouring cooling coil 3 via a metal block 14 of, for example, copper, but is heat-insulated with respect to the vapour space 2*b* by means of a layer 15 of a heat-insulating material, for example, synthetic material.

In combination with the restriction 13 in the same inlet duct 4, the heat exchanger 12 forms a blocking device which is passive during normal operation.

During normal operation, liquid hydrogen flows from heat exchanger 8 to the heat exchangers 12 under a pressure of, for example, 1.2 ata. Because the pressure of the liquid hydrogen in the heat exchanger 12 before the restriction 13 is higher than the pressure of the liquid hydrogen in cooling coil 3 behind the restriction, the temperature in the heat exchanger 12 is also higher than that in the cooling coil 3, so that the hydrogen in the heat exchanger 12 is cooled, via the metal block 14, by the hydrogen in the cooling coil 3.

Any gaseous hydrogen component flowing through the heat exchanger 12, formed elsewhere by heat leakage, condenses in this heat exchanger, with the result that only or substantially only liquid hydrogen enters the restriction 13. Because of the high density of the liquid hydrogen, the restriction 13 offers comparatively little resistance for the passage of this liquid hydrogen.

Besides the cooling of the heat exchanger 12, the cooling coil 3 ensures that the hydrogen vapour formed by normal heat leakage in the Dewar vessel 1 is condensed again.

Should the vacuum jacket of one of these two Dewar vessels start to leak, the large quantity of inflowing heat causes a pronounced temperature rise in the leaking Dewar vessel, with the result that the cooling coil 3 is heated. The cooling coil 3 in its turn heats the heat exchanger 12. The liquid hydrogen flowing through the relevant heat exchanger 12 is then heated and evaporated. Instead of liquid hydrogen, gaseous hydrogen then flows to the relevant restriction 13. Because the density of gaseous hydrogen is substantially lower than that of liquid hydrogen, the restriction 13 forms a high resistance to the hydrogen gas which resistance is sufficiently high to ensure that substantially no hydrogen gas passes this restriction, with the result that the supply of hydrogen to the relevant cooling coil 3 is substantially completely blocked. The flow of liquid hydrogen delivered by pumping device 11 is then substantially completely supplied to the cooling coil arranged inside the Dewar vessel which is still in order. Consequently, the latter Dewar vessel is not impeded by the pronounced leakage of heat in the other Dewar vessel.

If a gas such as helium is used under pressure as the cooling medium in the closed duct system shown in FIG. 1, this gas will be substantially heated in the relevant heat exchanger via the cooling coil 3 in the case of leakage of a Dewar vessel. As a result, the density of this gas substantially decreases and the viscosity increases, which means that the relevant restriction now constitutes a high resistance for the heated gas, so that the gas flow is substantially blocked.

Figure 2:
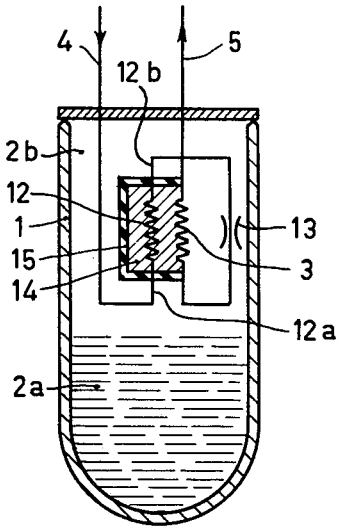
FIGS. 2 and 3 are longitudinal sectional views of Dewar vessels wherein different alternatives of the portion of the cooling device situated inside a Dewar vessel as shown in FIG. 1 are arranged.
Figure 3:
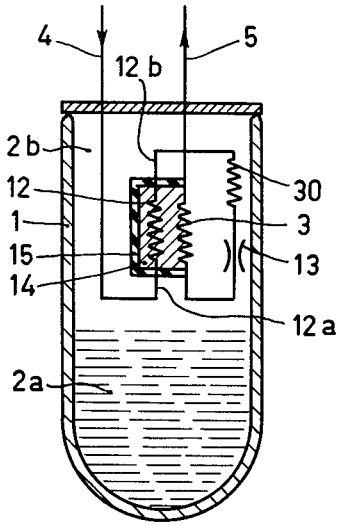

The same reference numerals have been used in the FIGS. 2 and 3 for the parts which correspond to FIG. 1.

The heat exchanger 12 in FIG. 2 is arranged in the vapour space 2*b* such that the inlet 12*a* is situated at a low level and the outlet 12*b* is situated at a higher level of the heat exchanger 12. When use is made of a liquid cooling medium, any gaseous component present therein, tending to rise in the liquid inside the heat exchanger 12 because of its lower specific density, will then rise in the desired direction towards the restriction rather than in the direction of the inlet duct 4. Consequently, the gas is not liable to collect in the heat exchanger 12 (which would disturb the operation of the blocking mechanism). Further, in the case of leakage, the blocking mechanism is actuated more rapidly. The remaining operations of the blocking mechanism are similar to that of the mechanism shown in FIG. 1.

FIG. 3 deviates from FIG. 2 in that the inlet duct 4 includes between the heat exchanger 12 and the restriction 13, a heat-exchanging element 30 which is arranged in the vapour space 2*b* in good thermal contact therewith. In the case of an undesirable temperature rise inside the Dewar vessel 1, heat will be applied to the heat-exchanging element 30 and to the cooling medium flowing therethrough. Consequently, liquid flowing through the heat-exchanging element 30 will be evaporated therein so that the blocking mechanism operates very quickly.

It is understood that the foregoing considerations are, of course, also applicable to cooled spaces other than cryostats containing liquefied gas, for example, to refrigerating apparatus which comprise freeze-drying spaces, deep-freeze spaces, vacuum spaces, spaces inside vapour-deposition installations etc.

What is claimed is:

1. A cooling device for maintaining a low operating temperature in an enclosure, comprising, boundary means defining said enclosure and containing a liquified gas, said enclosure having an inlet duct conveying a flow of cooled medium to said enclosure, and an outlet duct for conveying said cooled medium from said enclosure, said ducts passing through at least one boundary wall defining said enclosure, the path between said inlet duct and said outlet duct including the serial connection of a heat exchanger, a restriction means and a cooling element, said restriction means being situated between said heat exchanger and said cooling element, means positioning said heat exchanger in said enclosure in heat exchanging contact with said cooling element, and means for heat insulating said heat exchanger from said enclosure.

2. A cooling device as claimed in claim 1, wherein said inlet of said heat exchanger is situated in said enclosure at a level lower than that of the outlet of said heat exchanger.

3. A cooling device as claimed in claim 2, wherein at least one heat exchanging element is included in said inlet duct between said heat exchanger and said restriction means, said heat exchanging element being arranged in said enclosure in heat exchange contact with said enclosure.

4. The cooling device of claim 1, wherein said means positioning is a metal block physically contacting both said cooling element and said heat exchanger.

5. The cooling device of claim 1, wherein said means positioning is a copper block physically contacting both said cooling element and said heat exchanger.

6. The cooling device of claim 1, wherein said means for heat insulating said heat exchanger from said enclosure is a layer of heat insulating material at least partially enclosing said heat exchanger.

* * * * *